US011083251B2

(12) United States Patent
Fiedler

(10) Patent No.: US 11,083,251 B2
(45) Date of Patent: Aug. 10, 2021

(54) CLOSURE DEVICE FOR DETACHABLY CONNECTING TWO PARTS

(71) Applicant: Fidlock GmbH, Hannover (DE)

(72) Inventor: Joachim Fiedler, Hannover (DE)

(73) Assignee: Fidlock GmbH, Hannover (DE)

( * ) Notice: Subject to any disclaimer, the term of this patent is extended or adjusted under 35 U.S.C. 154(b) by 201 days.

(21) Appl. No.: 16/071,182

(22) PCT Filed: Dec. 19, 2016

(86) PCT No.: PCT/EP2016/081805
§ 371 (c)(1),
(2) Date: Dec. 10, 2018

(87) PCT Pub. No.: WO2017/125229
PCT Pub. Date: Jul. 27, 2017

(65) Prior Publication Data

US 2019/0343239 A1 Nov. 14, 2019

(30) Foreign Application Priority Data

Jan. 23, 2016 (DE) ..... 10 2016 200 944.3

(51) Int. Cl.
*A44B 11/25* (2006.01)
*A41F 1/00* (2006.01)
*A45C 13/10* (2006.01)

(52) U.S. Cl.
CPC ..... *A44B 11/258* (2013.01); *A41F 1/002* (2013.01); *A45C 13/1069* (2013.01); *A44D 2203/00* (2013.01)

(58) Field of Classification Search
CPC ..... A41F 1/002; A44B 11/258; A44C 5/2071; A44D 2203/00; A45C 13/1069
See application file for complete search history.

(56) References Cited

U.S. PATENT DOCUMENTS 3,266,112 A * 8/1966 Heckman ..... A44B 19/16 24/400
4,399,595 A * 8/1983 Yoon ..... A41F 1/002 24/303

(Continued)

FOREIGN PATENT DOCUMENTS

CN 101081115 A 12/2007
CN 202618405 U 12/2012

(Continued)

*Primary Examiner* — Robert Sandy
*Assistant Examiner* — David M Upchurch
(74) *Attorney, Agent, or Firm* — The Webb Law Firm

(57) ABSTRACT

A closure device for detachably connecting two parts to one another includes a first closure part which has at least two first magnetic sections which are spaced apart from one another and form an intermediate space between one another, and a second closure part which has at least one second magnetic section. The first closure part and the second closure part can be attached to one another along a closure direction in such a way that the closure device assumes a closed position in which the at least one second magnetic section is accommodated at least partially by the intermediate space. In the closed position, an attractive magnetic force, which is directed substantially perpendicular to the closure direction, thereby acts both between the at least one second magnetic section and each of the at least two first magnetic sections forming the intermediate space.

20 Claims, 8 Drawing Sheets

(56) References Cited

U.S. PATENT DOCUMENTS

| | | | | |
|---|---|---|---|---|
| 4,941,236 | A | 7/1990 | Sherman et al. | |
| 5,664,298 | A * | 9/1997 | Nessar-Ivanovic | A44C 5/2071 24/303 |
| 6,292,985 | B1 * | 9/2001 | Grunberger | A44B 11/2592 24/303 |
| 6,301,754 | B1 * | 10/2001 | Grunberger | A41F 1/002 24/303 |
| 7,320,158 | B2 * | 1/2008 | Deto | A44B 19/384 24/303 |
| 8,997,318 | B2 * | 4/2015 | Nicolas | A44C 5/14 24/303 |
| 9,721,712 | B2 * | 8/2017 | Provencher | A41F 1/002 |
| 2004/0107547 | A1 | 6/2004 | Chung | |
| 2007/0277353 | A1 | 12/2007 | Kondo et al. | |
| 2009/0119889 | A1 | 5/2009 | Tanaka et al. | |
| 2012/0000038 | A1 | 1/2012 | Humphries et al. | |
| 2015/0135486 | A1 | 5/2015 | Fiedler et al. | |
| 2016/0073744 | A1 | 3/2016 | Fiedler et al. | |

FOREIGN PATENT DOCUMENTS

| | | | |
|---|---|---|---|
| CN | 104853636 | A | 8/2015 |
| DE | 102007024118 | A1 | 12/2007 |
| DE | 202009006189 | U1 | 10/2010 |
| JP | S58105430 | U | 7/1983 |
| JP | 2006149824 | A | 6/2006 |
| JP | 2007130043 | A | 5/2007 |
| JP | 2007319253 | A | 12/2007 |
| WO | 2010100744 | A1 | 9/2010 |
| WO | 2012172693 | A1 | 12/2012 |
| WO | 2014180512 | A1 | 11/2014 |

* cited by examiner 1
2
21
26
27
31
3
A
A'
x
y
z
x'
y'

1
2
3
20
21
22
23
24
25
241
251
26
27
271
231
30
31
33
331
371
34
341
35
36
37
N
S

CLOSURE DEVICE FOR DETACHABLY CONNECTING TWO PARTS

CROSS-REFERENCE TO RELATED APPLICATIONS

This application is the United States national phase of International Application No. PCT/EP2016/081805 filed Dec. 19, 2016, and claims priority to German Patent Application No. 10 2016 200 944.3 filed Jan. 23, 2016, the disclosures of which are hereby incorporated in their entirety by reference.

BACKGROUND OF THE INVENTION

Field of the Invention

The invention concerns in particular a closure device for detachably connecting two parts together.

Description of Related Art

Such a closure device comprises a first closure part which has at least two first magnetic portions which are spaced apart from one another and form an intermediate space between them, and a second closure part which has at least one second magnetic portion. Here, the first closure part and the second closure part can be placed against each other in a closing direction such that the closure device assumes a closed position, in which the at least one second magnetic portion is received at least partially in the intermediate space. In the closed position, an attractive magnetic force, which is oriented substantially perpendicularly to the closing direction, acts between firstly the at least one second magnetic portion and secondly each of the at least two first magnetic portions forming the intermediate space.

SUMMARY OF THE INVENTION

With closure devices, the object is frequently to allow simple operation on closure and opening, and secondly to guarantee a secure closed position from which no unintentional opening of the closure device is possible.

This object is achieved according to a first aspect of the invention by a closure device with features as described herein.

Accordingly, it is provided that the first closure part has at least one first form-fit portion, and the second closure part has at least one second form-fit portion, wherein, in the closed position, the at least one first form-fit portion and the at least one second form-fit portion stand in form-fit engagement with each other in order to prevent a relative movement of the closure parts relative to each other parallel to the closing direction. In other words, the form-fit portions of the first closure part on one side and of the second closure part on the other engage behind each other in the closed position by form fit relative to the closing direction.

The form-fit engagement of the two closure parts allows a secure connection in the closed position of the closure device. Also, in this way, shear forces acting on the closure parts can be absorbed.

The closure parts may preferably be formed substantially rigidly. For example, the closure parts may consist at least partially of a nylon material.

In one embodiment in accordance with the above-mentioned first aspect of the invention and in accordance with each of the second, third, and fourth aspects described below, the at least one first form-fit portion and/or the at least one second form-fit portion has a form-fit face running obliquely to the closing direction. In the closed position, a complementary form-fit face on the respective other form-fit portion may engage by undercut behind the oblique form-fit face.

In another embodiment in accordance with the above-mentioned first aspect of the invention and in accordance with each of the second, third, and fourth aspects described below, the first form-fit portion and/or the second form-fit portion is formed by a mechanical undercut on the respective closure part. The first form-fit portion and/or the second form-fit portion may, in a variant, have at least one form-fit face running substantially perpendicularly to the closing direction.

According to a refinement in accordance with the above-mentioned first aspect of the invention and in accordance with each of the second, third, and fourth aspects described below, on at least one of the closure parts, at least one first guide portion is provided which is configured, when the closure parts are placed against each other, to predefine a relative movement of the closure parts against each other and in a direction perpendicular to the closing direction, in order to bring the at least one first form-fit portion and the at least one second form-fit portion into form-fit engagement with each other. For example, the at least one first guide portion on the at least one closure part may comprise a first guide face running obliquely to the closing direction. For example, the at least one first guide portion may be formed by a face of the magnetic portion running obliquely to the closing direction.

In a variant, a plurality of first and second magnetic portions is provided. In the closed position of the closure device, the second magnetic portions may be received at least partially by a plurality of intermediate spaces which are each formed between two first magnetic portions.

In a variant in accordance with the above-mentioned first aspect of the invention and in accordance with each of the second, third, and fourth aspects described below, at least one of the permanent magnets has a cross-section in the form of a non-rectangular parallelogram.

The object is also achieved by closure devices according to a second, third and fourth aspect of the invention. These further aspects of the invention each concern a closure device for detachably connecting two parts together, with a first closure part which has at least one first magnetic portion and at least one form-fit portion, and with a second closure part which has at least one second magnetic portion and at least one second form-fit portion. The first closure part and the second closure part may here be placed against each other in a closing direction such that the closure device assumes a closed position in which an attractive magnetic force, which is oriented substantially perpendicularly to the closing direction, acts between the at least one first magnetic portion and the at least one second magnetic portion. Furthermore, in the closed position, the at least one first form-fit portion and the at least one second form-fit portion stand in form-fit engagement with each other, in order to prevent a relative movement of the closure parts against each other parallel to the closing direction.

According to the second aspect of the invention, it is provided that at least one of the magnetic portions has a cross-section in the form of a non-rectangular parallelogram, wherein the first form-fit portion and/or the second form-fit portion is formed by a face of the magnetic portion running obliquely to the closing direction. In particular in a cascaded embodiment with at least three first magnetic portions and the resulting at least two intermediate spaces, this has the following advantage: if the second closure part is moved out of a first closed position, in which it is received by a first intermediate space, into a second closed position, in which it is received by a second intermediate space, this may be achieved by a force F applied in a direction perpendicular to the closing direction Z, without the closure device first having to be opened by a force acting against the closure direction, since the side faces of the magnetic portions with parallelogram-shaped cross-section divert the force accordingly. The closure device thus acts as a free-running device which blocks in one direction and can easily be adjusted in the other direction.

In a variant, at least one of the magnetic portions comprises a permanent magnet which has a cross-section in the form of a non-rectangular parallelogram.

According to a further, third aspect of the invention, when a shear load is applied for closure, the magnetic portions lie behind each other in relation to the action direction of the shear load.

Thus according to the third aspect of the invention, it is provided that the first closure part and the second closure part can be placed against each other in the closing direction and here can be loaded with a shear force applied perpendicularly to the closing direction such that the closure device assumes its closed position. Furthermore, at least one first guide portion is configured, when the closure parts are placed against each other, to predefine a relative movement of the closure parts against each other in a direction perpendicular to the closing direction, in order to bring the at least one first form-fit portion and the at least one second form-fit portion into form-fit engagement with each other. Moreover, it is provided here that at least one first magnetic portion and the at least one second magnetic portion are arranged behind one another, collinearly with the action direction of the shear force occurring for assumption of the closed position.

According to the fourth aspect of the invention, in a closure device of the type cited initially, on at least one closure part, at least one first guide portion and at least one second guide portion are provided. Here, the at least one second guide portion is configured, when the closure parts are placed against each other, to predefine a first relative movement of the closure parts against each other in a direction perpendicular to the closing direction, in order to bring the respective other closure part into contact with the at least one first guide portion. In addition, the at least one first guide portion is configured, when the closure parts are placed against each other, to predefine a relative movement of the closure parts against each other in a direction perpendicular to the closing direction, in order to bring the at least one first form-fit portion and the at least one second form-fit portion into form-fit engagement with each other.

Thus when the closure parts are placed against each other, one of the closure parts can be deflected by means of the second guide portion, in a first step, perpendicularly to the application direction such that it comes into contact with a first guide portion. In this way, when the closure parts are placed against each other, a tolerance can be ensured, which simplifies closure of the closure device.

In a second step, the closure part may be moved along the first guide portion in the direction of the form-fit portion of the other closure part in order to come into engagement therewith and create the closed position of the closure device. It is also possible that, when the closure parts are placed against each other, the one closure part comes directly into contact with the first guide portion of the other closure part without first being deflected on the second guide portion. Also, the first guide portion in itself thus contributes to a tolerance in the positioning movement and hence to a simple closing process of the closure device.

The second relative movement proposed according to the fourth aspect of the invention may be at least partially oriented against the first relative movement. For example, on the first relative movement, the second closure part may be moved opposite a direction defined by an undercut on the first closure part, and on the second relative movement, be moved in the direction defined by the undercut of the first closure part.

In a variant, the at least one first guide portion on the at least one closure part comprises a first guide face running obliquely to the closing direction, and/or the at least one second guide portion comprises a second guide face running obliquely to the closing direction. Here, the respective other closure part may have at least one first contact portion for sliding on the first guide face, and/or at least one second contact portion for sliding on the second guide face.

In an exemplary embodiment of each of the four above-mentioned aspects of the invention, the first closure part and/or the second closure part comprises a base body which extends substantially parallel to a respective extension plane. In the closed position of the closure device, the closing direction thus stands perpendicularly on the extension plane of the first closure part and/or on the extension plane of the second closure part.

In a variant, at least one magnetic portion provided on a closure part, and/or at least one permanent magnet provided on a closure part, has at least one face which is oriented obliquely to the extension plane of the base body and forms a form-fit face, a guide face and/or a contact face.

In a further variant in accordance with each of the four above-mentioned aspects, the first closure part has a plurality of first magnetic portions which are evenly spaced apart, wherein in each case two first magnetic portions form between them an intermediate space which is configured to at least partially receive the at least one second magnetic portion in the closed position. Additionally or alternatively, the second closure part may comprise a plurality of second magnetic portions which are evenly spaced apart from each other, wherein in each case two second magnetic portions form between them an intermediate space which is configured to at least partially receive the at least one first magnetic portion in the closed position.

In a further variant in accordance with each of the four above-mentioned aspects, the at least one first magnetic portion comprises at least one first permanent magnet with a first magnetization direction, and the at least one second magnetic portion comprises at least one second permanent magnet with a second magnetization direction. For example, in the closed position of the closure device, the at least one first magnetic portion and the at least one second magnetic portion may be arranged such that the first magnetization direction and the second magnetization direction run parallel to each other and are oriented substantially perpendicularly to the closing direction. For example, in the closed position of the closure device, the at least one first magnetic portion and the at least one second magnetic portion may be arranged behind one another in relation to the first magnetization direction and the second magnetization direction. In a variant, at least one of the permanent magnets has a cross-section in the form of a non-rectangular parallelogram. Further, in a variant, the first closure part and the second closure part may be formed structurally identically apart from the respective magnetization directions of the first and second permanent magnets.

The four aspects of the invention mentioned above may be combined with each other arbitrarily.

BRIEF DESCRIPTION OF THE DRAWINGS

Possible variant embodiments according to the above-mentioned aspects of the invention are illustrated in the attached figures and their description.

The drawings show.

DESCRIPTION OF THE INVENTION

FIGS. 1A to 1I show various views of a first exemplary embodiment of a closure device 1 with magnetic portions 21, 31 and form-fit portions 23, 33. Such a closure device 1 may be provided in general for detachably connecting two parts together. For example, such a closure device 1 may be arranged on a garment or on a bag.

Figure 1A:
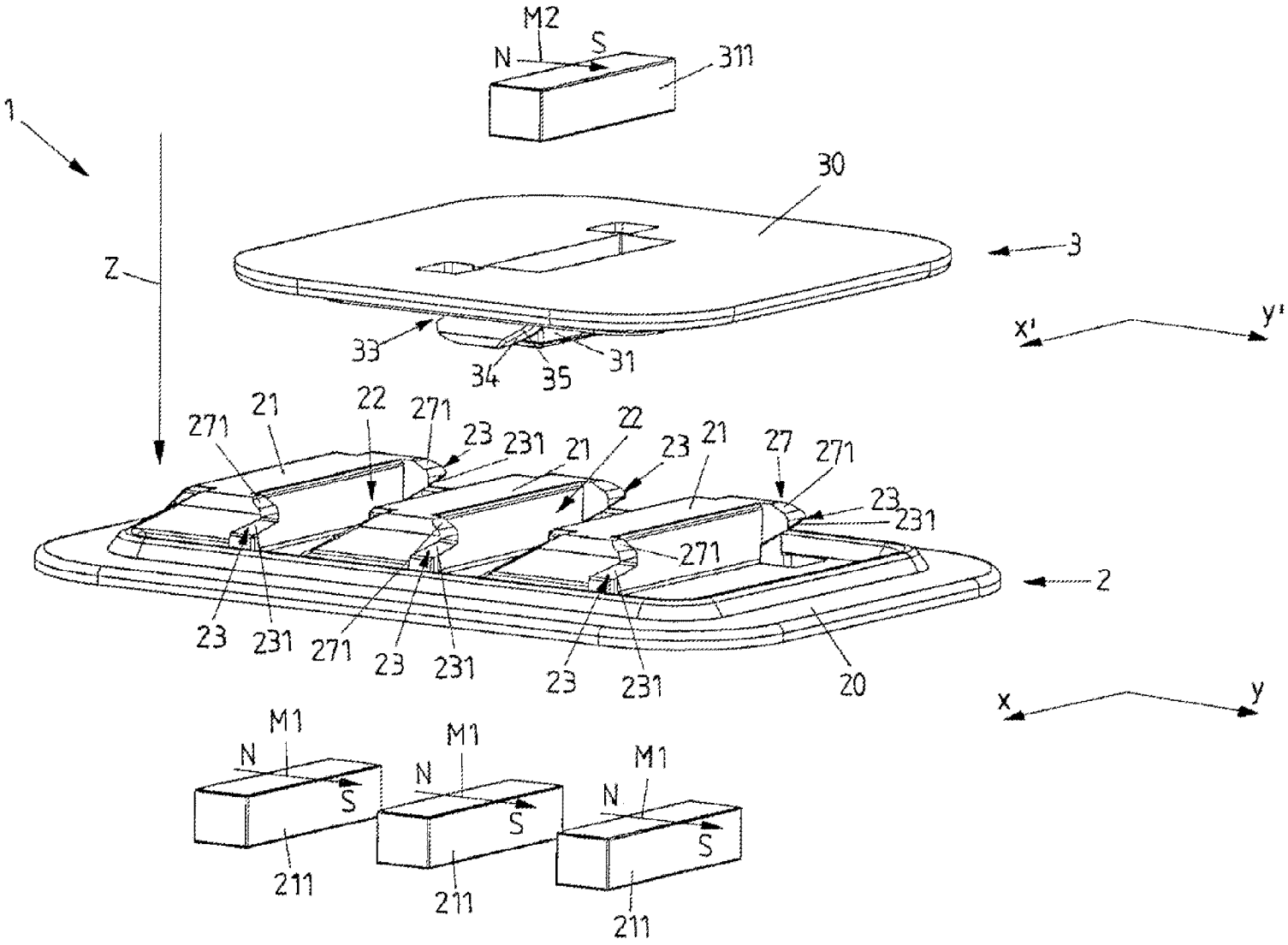
FIG. 1A a perspective, exploded view of an exemplary embodiment of a closure device with magnetic portions and form-fit portions.

As illustrated for example in FIG. 1A, the closure device 1 has a first closure part 2 and a second closure part 3, wherein the two closure parts 2, 3 may be placed against each other in a closing direction Z to close the closure device 1. Each closure part 2, 3 has a base body 20, 30 which extends substantially in a respective extension plane XY, X'Y'.

Three first magnetic portions 21 are arranged on the base body 20 of the first closure part 2, wherein in each case two adjacent magnetic portions 21 are spaced apart from each other and form an intermediate space 22 between them. A second magnetic portion 31 is arranged on a side of the base body 30 of the second closure part 3 facing the first magnetic portions 21.

The exploded view in FIG. 1A clearly shows that each first magnetic portion 21 comprises a first permanent magnet 211 with a first magnetization direction M1, wherein the first magnetization direction M1 points from a north pole N to a south pole S of the respective first permanent magnet 211. Accordingly, the second magnetic portion 31 also comprises a second permanent magnet 311 with a second magnetization direction M2 which points from a north pole N to a south pole S of the second permanent magnet 311. On use of the closure device 1, the permanent magnets 211, 311 are arranged in recesses provided for this in the first magnetic portions 21 and second magnetic portion 31 respectively.

Figure 1B:
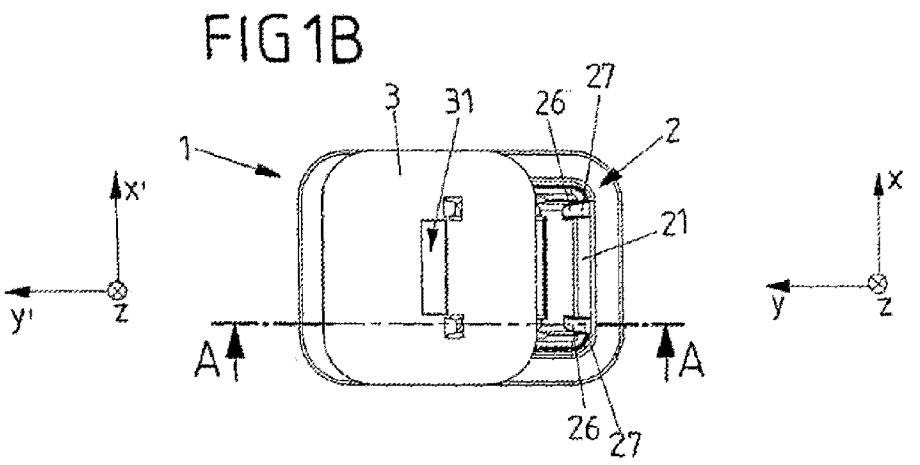
FIG. 1B-1I top views and sectional views of the closure device from FIG. 1A.
Figure 1C:
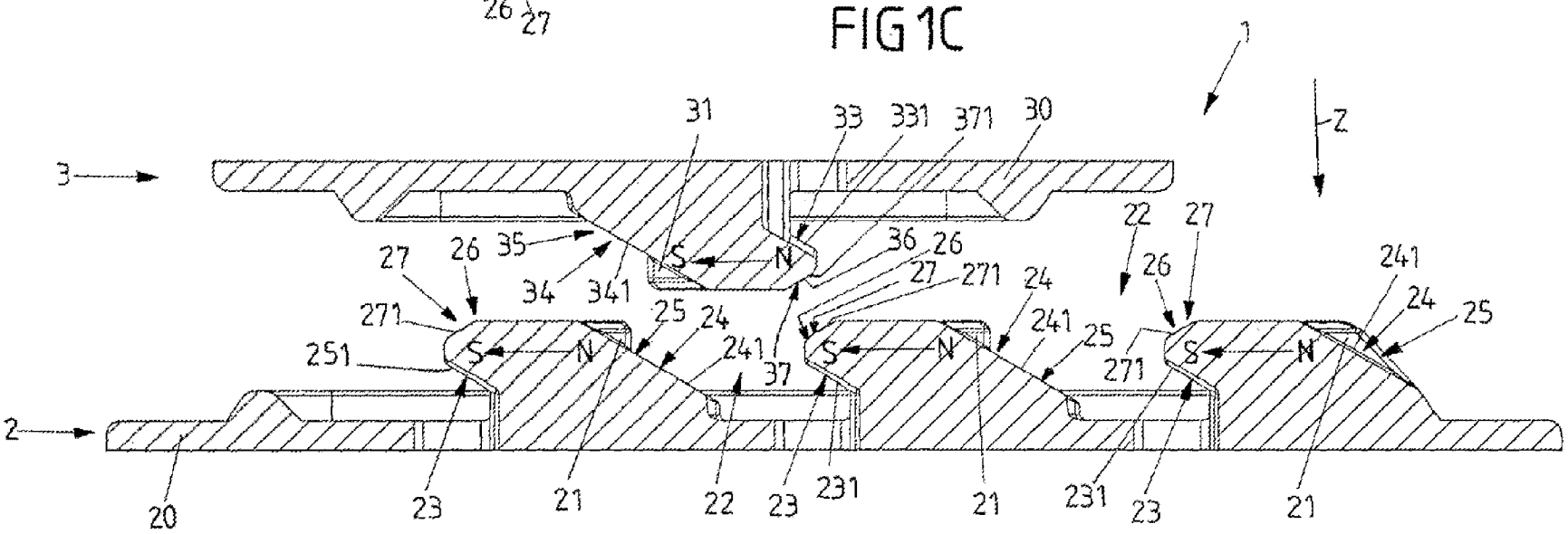
Figure 1D:
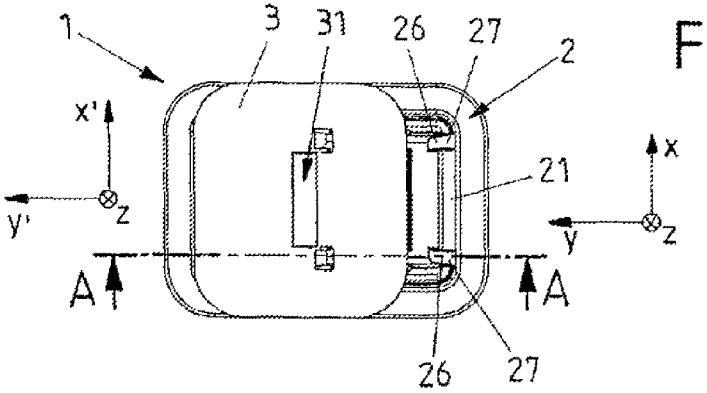
Figure 1E:
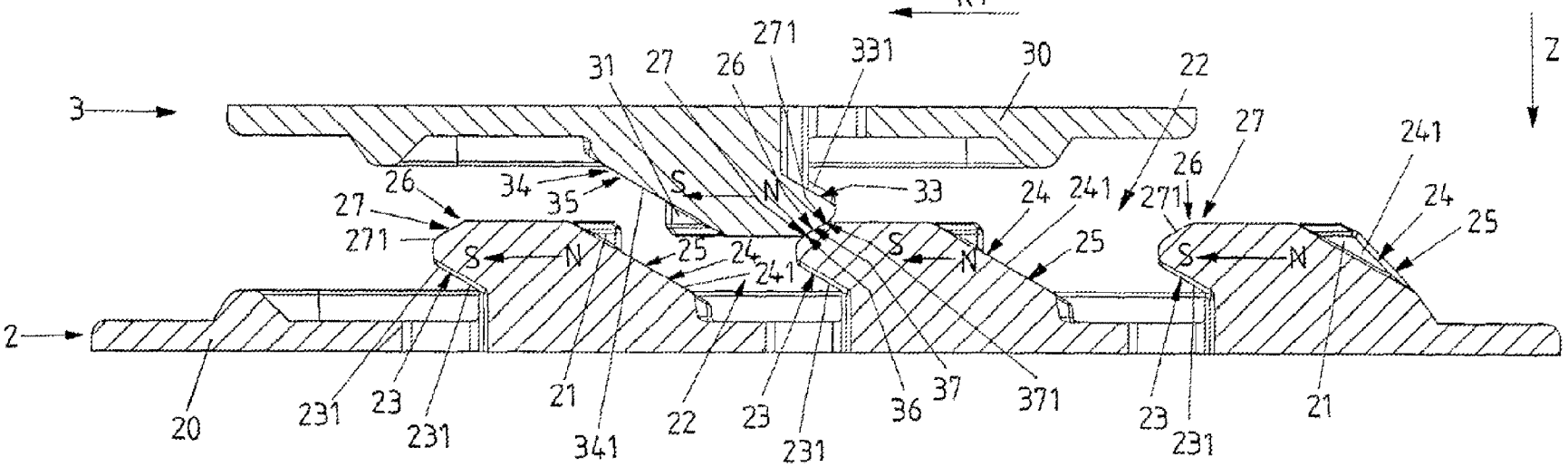
Figure 1F:
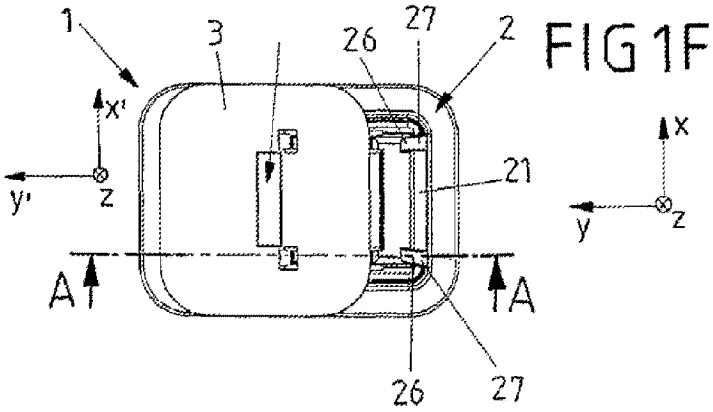
Figure 1G:
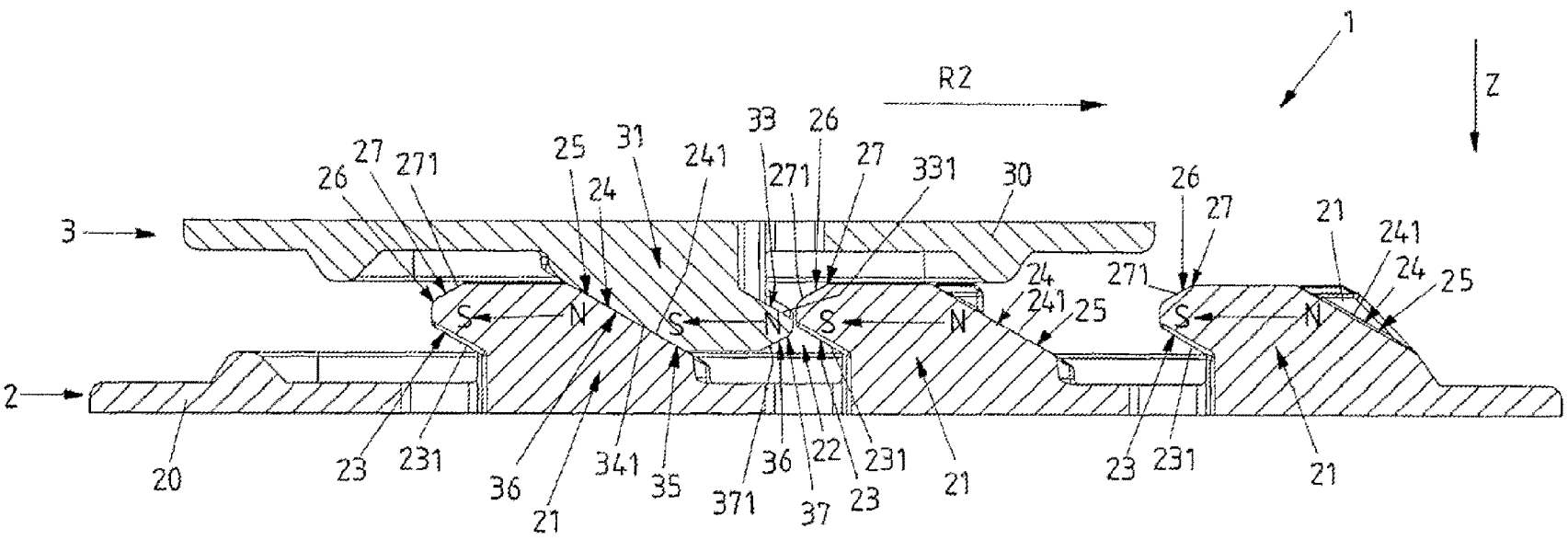
Figures 1H, 1I:
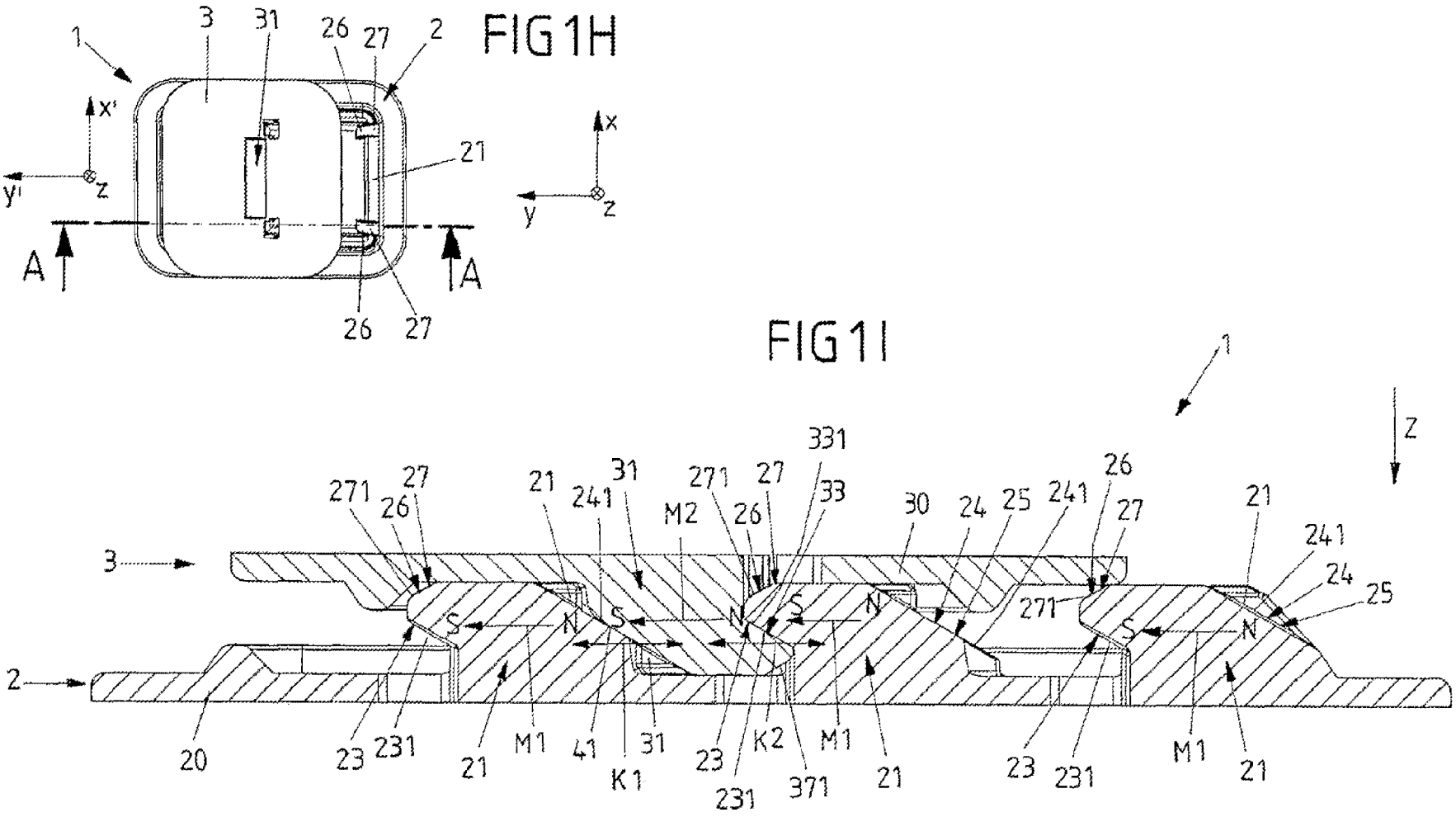

To close the closure device 1, the first closure part 2 and the second closure part 3 may be placed against each other in the closing direction Z such that the closure device 1 assumes the closed position shown in FIG. 1I. In the closed position, the respective extension planes XY, X'Y' of the base bodies 20, 30 of the first closure part 2 and second closure part 3 are oriented substantially parallel to each other and perpendicularly to the closing direction Z.

It is clear from FIG. 1I that in the closed position, the second magnetic portion 31 is received by an intermediate space 22 formed between two adjacent magnetic portions 21. Here, an attractive magnetic force K1, K2, oriented substantially perpendicularly to the closing direction Z, acts between firstly the second magnetic portion 31 and secondly each of the two first magnetic portions 21 forming the intermediate space 22, according to the mutually facing orientation of the north and south poles N, S. The attractive magnetic forces K1, K2 in a direction perpendicular to the closing direction Z hold the closure device 1 securely in its closed position.

To generate the attractive magnetic forces K1, K2 in the closed position, the permanent magnets 211, 311 are arranged in the respective magnetic portions 21, 31 such that the first magnetization direction M1 and the second magnetization direction M2 run parallel to each other and are oriented substantially perpendicularly to the closed position Z. In the closed position, the magnetization directions M1, M2 and the attractive magnetic forces K1, K2 run substantially parallel to the extension planes XY, X'Y' of the base bodies 20, 30.

FIGS. 1B to 1I, which are described in more detail below, illustrate as an example a possible closing process of the closure device 1. FIGS. 1B, 1D, 1F and 1H each show a view of the closure device 1 according to FIG. 1A, and the respective following FIGS. 1C, 1E, 1G and 1I show associated sectional depictions along the respective section line A-A.

FIGS. 1B and 1C show an open state of the closure device 1. In contrast, FIGS. 1H and 1I illustrate a closed position of the closure device 1. Possible intermediate positions, which the closure device 1 may assume during a closing process, are shown in FIGS. 1D to 1G.

In addition to the magnetic portions 21, the first closure part 2 comprises six form-fit portions 23, two of which in each case laterally encase a magnetic portion 21 and which each have a form-fit face 231 running obliquely to the closing direction. The three form-fit portions 23, like the magnetic portions 21, are arranged at regular distances apart on the base body 20 of the first closure part 2. Also, the second closure part 3 comprises two second form-fit portions 33 which are complementary to the first form-fit portions 23 and laterally encase the second magnetic portion 31, and each of which has a form-fit face 331 running obliquely to the closing direction Z.

The first form-fit portions 23 firstly, and the second form-fit portions 33 secondly, are provided and arranged to stand in form-fit engagement with each other in the closed position of the closure device 1, so as to prevent a relative movement of the closure parts 2, 3 relative to each other in a direction oriented against the closing direction Z, which would separate the closure parts 2, 3 from each other. In other words, the form-fit portions 23, 33 of the first closure part 2 firstly and of the second closure part 3 secondly engage behind each other in the closed position by form fit relative to the closure direction Z, see FIG. 1I. To this end, the oblique form-fit faces 231 of the first form-fit portions 23 face the base body 20 of the first closure part 2. The form-fit faces 331 of the second form-fit portions 33 accordingly face the base body 30 of the second closure part 3.

The form-fit engagement of the two closure parts 2, 3 by means of the form-fit portions 23, 33 allows a secure connection in the closed position of the closure device 1. An unintentional opening of the closure device 1 by a relative movement of the closure part 2, 3 against the closing direction Z, which would separate the two closure parts 2, 3 from each other, can thus be prevented. Also, due to the form fit of the form-fit portions 23, 33 with each other, external shear forces, which may act on the closure parts 2, 3 perpendicularly to the closing direction Z, can be absorbed.

In another variant (not shown), the first form-fit portions 23 and/or the second form-fit portions 33 may be formed by a "true" mechanical undercut on the respective closure part 2, 3, wherein the first form-fit portions 23 and/or the second form-fit portions 33 each have at least one form-fit face running substantially perpendicularly to the closing direction Z.

Furthermore, respective first guide portions 24, 34 are provided on the two closure parts 2, 3. In the exemplary embodiment shown, the first guide portions 24, 34 are configured as first guide faces 241, 341, running obliquely to the closing direction Z, on the form-fit portions 23, 33 which laterally encase the magnetic portions 21, 31.

As FIG. 1G illustrates as an example, the first guide portions 24, 34 are configured to predefine, on application of the closure parts 2, 3 against each other, a relative movement R2 of the closure parts 2, 3 against each other in a direction perpendicular to the closing direction Z, in order to bring the at least one first form-fit portion 23 and the at least one second form-fit portion 33 into a form-fit engagement with each other, which corresponds to the closed position shown in FIG. 1I.

To this end, the first guide faces 241 of the first closure part 2 each form a first contact portion 25 for sliding on the first guide faces 341 of the second closure part 3. Conversely, the first guide faces 341 of the second closure part 3 each form a first contact portion 35 for sliding on the first guide faces 241 of the first closure part 2.

For example, when the second closure part 3 is placed against the first closure part 2 in the closing direction Z, the second closure part 3 with its first contact portions 35 can slide on the first guide faces 241 of the first closure part 2, and is thereby deflected perpendicularly to the closing direction Z (corresponding to the relative movement R2 drawn on FIG. 1G), such that the form-fit faces 231, 331 of the first closure part 2 and of the second closure part 3 come into form-fit engagement with each other in order to prevent a relative movement in a direction parallel to the closing direction Z, which would separate the closure parts 2, 3 from each other.

When sliding on the first guide faces 241 of the first closure part 2, the second closure part 3 is loaded with a shear force applied perpendicularly to the closing direction Z, which causes the deflection of the movement and the resulting relative movement R2 into the closed position. This process corresponds to the step from the intermediate position of the closure device 1 shown in FIG. 1G to the closed position shown in FIG. 1I.

In this way, a particularly simple closing process is achieved since a user need merely place the closure parts 2, 3 against each other approximately in the closing direction Z. The form-fit locking of the form-fit portions 23, 33 to each other then takes place almost automatically by the shear force provoked by means of the guide faces 241, 341 or by means of the contact portions 25, 35 and the resulting relative movement R2. The magnetic attraction between the magnetic portions 21, 31 here provides additional support for the closing process.

As FIG. 1I shows, in the closed position, the first magnetic portions 21 and the magnetic portion 31 are arranged behind each other collinearly with the action direction of the shear force occurring for assumption of the closed position, i.e. the direction of the relative movement R2. The first magnetization direction M1 of the first permanent magnets 211 arranged in the first magnetic portions 21, and the second magnetization direction M2 of the second permanent magnet 311 arranged in the second magnetic portion 31, run parallel to each other and are oriented substantially perpendicularly to the closing direction Z. With regard to the first magnetization direction M1 and the second magnetization direction M2, the first magnetic portions 21 and the second magnetic portion 31 are arranged behind each other.

The attractive magnetic forces K1, K2 in a direction perpendicular to the closing direction Z accordingly hold the closure device 1 in its closed position even when the closure parts 2, 3 are loaded with an external shear force acting against the relative movement R2, provided that the external shear force does not overcome the magnetic forces K1, K2. An unintentional opening of the closure device 1 can thus be prevented. In contrast, external shear forces which act on the closure parts 2, 3 in the direction of relative movement R2 can be absorbed by the form-fit engagement of the form-fit portions 23, 33 in the closed position.

In addition to the first guide portions 24, 34, respective second guide portions 27, 37 are provided on the two closure parts 2, 3. The second guide portions 27, 37 are also configured as second guide faces 271, 371 running obliquely to the closing direction Z on the form-fit portions 23, 33 which laterally encase the magnetic portions 21, 31.

The function of the second guide portions 27, 37 is evident from the step from the intermediate position shown in FIG. 1E to the intermediate position shown in FIG. 1G. Accordingly, the second guide portions 27, 37 are configured, when the closure parts 2, 3 are placed on each other, firstly to predefine a first relative movement R1 of the closure parts 2, 3 against each other in a direction perpendicular to the closing direction Z, in order to bring the first guide portions 24 of the first closure part 2 firstly and the second guide portions 34 of the second closure part 3 secondly into contact with each other (see FIG. 1G).

To this end, the second guide faces 271 of the first closure part 2 each form a second contact portion 26 for sliding on the second guide faces 371 of the second closure part 3. Conversely, the second guide faces 371 of the second closure part 3 each form a second contact portion 36 for sliding on the second guide faces 271 of the first closure part 2.

For example, the second closure part 3 may, in a first step, slide with its second contact portion 36 on the second guide faces 271 of the first closure part 2, and thereby be deflected perpendicularly to the closing direction Z (corresponding to the first relative movement R1 shown in FIG. 1E), such that the first guide faces 241, 341 of the first closure part 2 and second closure part 3 come into contact with each other (see FIG. 1G).

In a second step, then the second closure part 3, as has already been described above in relation to FIGS. 1G and 1I, may be moved along the first guide portion 24 in a second relative movement R2 in the direction of the form-fit portion 23 of the first closure part 2, in order to come into form-fit engagement therewith and thus create the closed position of the closure device 1. The second relative movement R2 is oriented against the first relative movement R1.

The interplay described between the second guide portions 27, 37 and the first guide portions 24, 34 guarantees a degree of tolerance when the closure parts 2, 3 are placed on each other, which simplifies closure of the closure device 1 for a user. Thus the user need not be concerned with placing the two closure parts 2, 3 precisely against each other in the region of the first guide portions 27, 37.

It is evidently also possible, when the closure parts 2, 3 are placed against each other, for the first closure part 2 to come directly into contact with the first guide portion 34 of the other closure part 3 without first being deflected on the second guide portion 37. Here, the contact may take place in the region of the entire width of the first guide portions 24, 34 so that a particularly precise application is not necessary. Also, the first guide portions 24, 34 themselves thus contribute to a tolerance in the positioning movement and hence to a particularly simple closing process of the closure device 1.

Figure 2A:
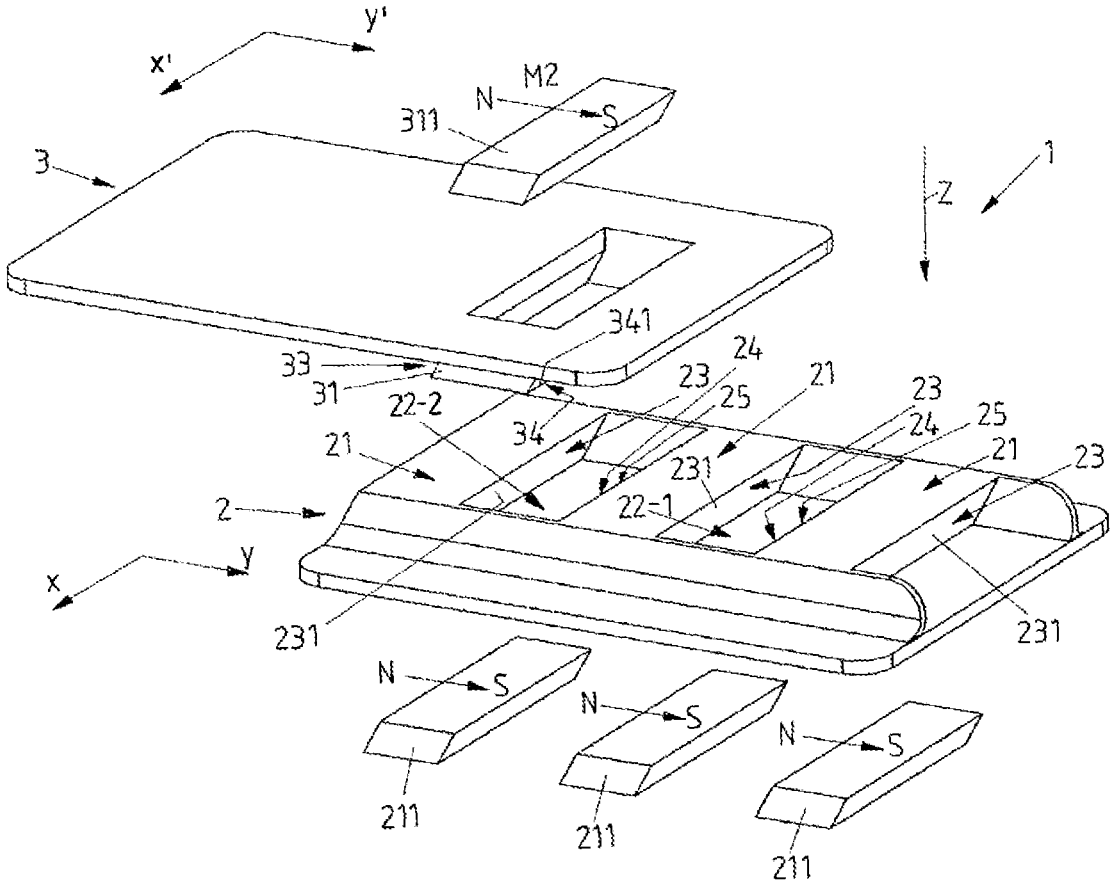
FIG. 2A a perspective, exploded view of an exemplary embodiment of a closure device with magnetic portions which have a parallelogram-shaped cross-section.
Figure 2B:
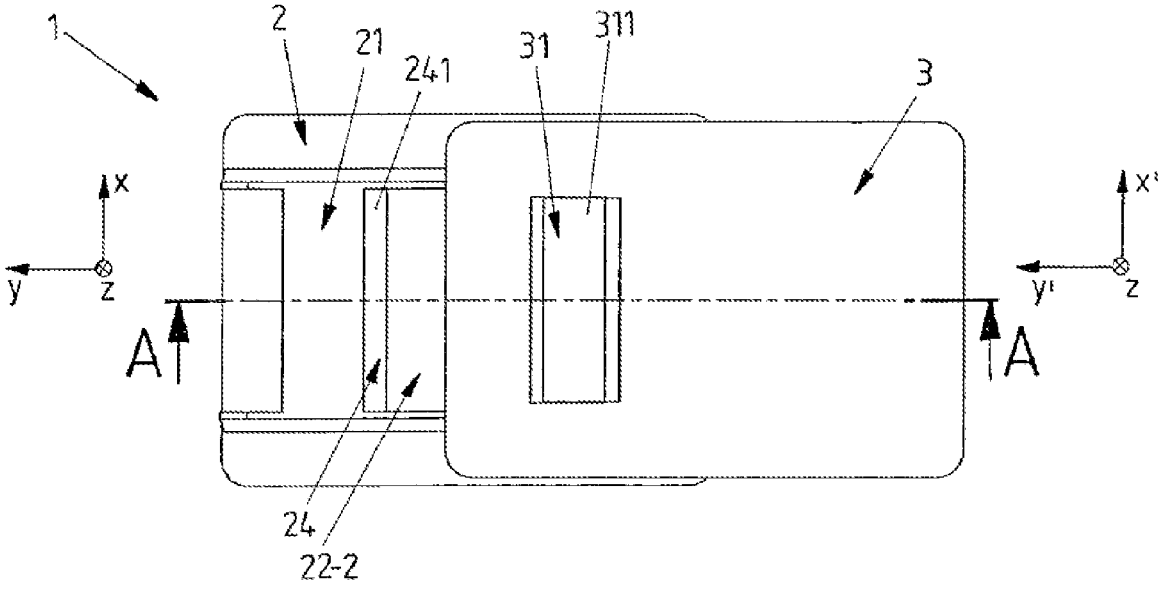
FIG. 2B-2D top views and sectional views of the closure device of FIG. 2A.
Figure 2C:
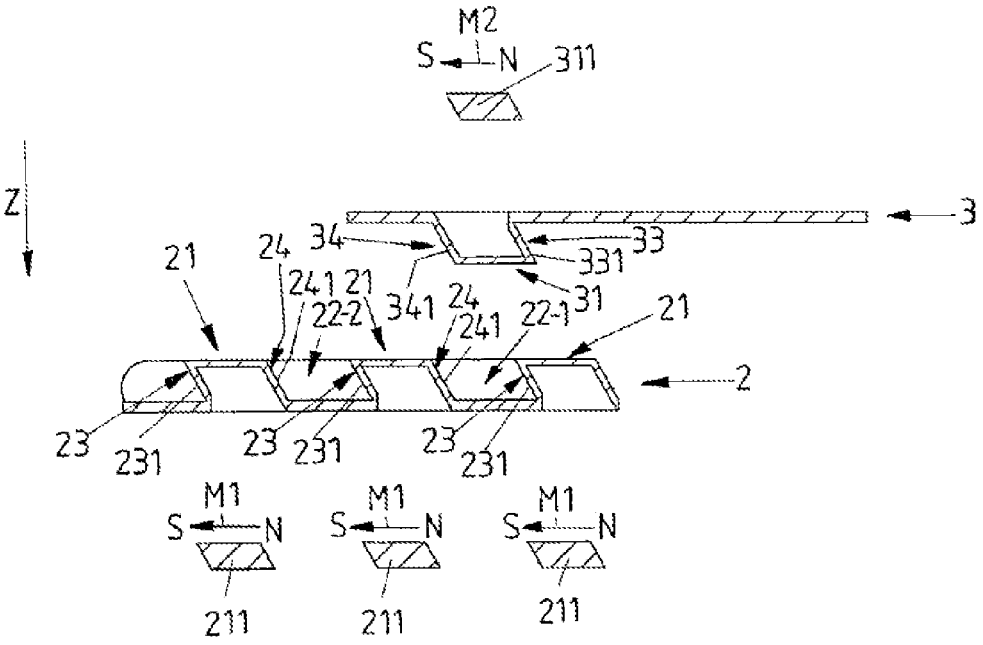
Figure 2D:
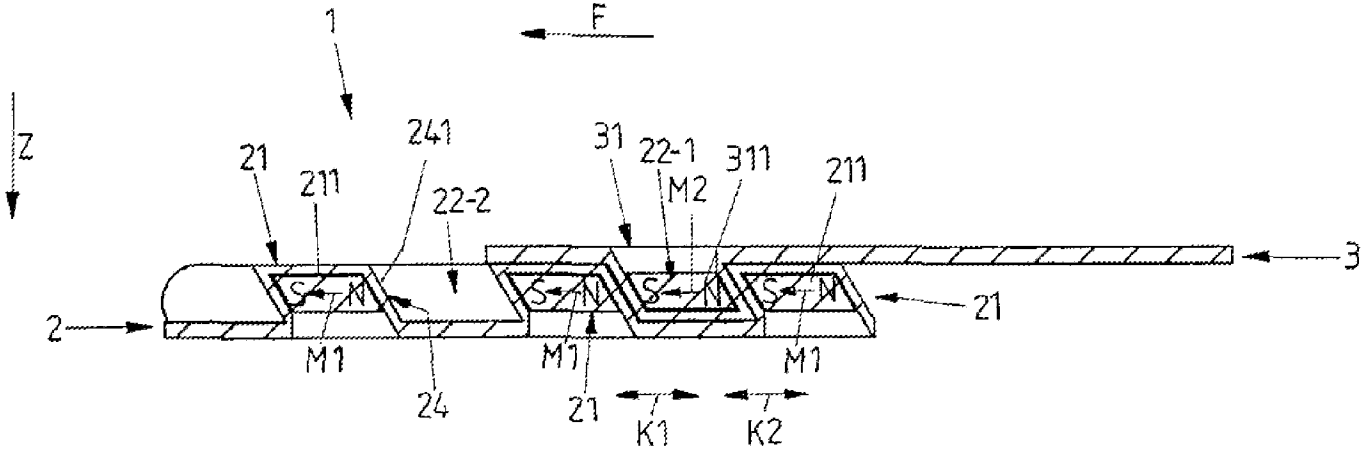

FIG. 2A shows, in a perspective, exploded view, a second exemplary embodiment of a closure device 1 according to the invention. FIG. 2B shows the closure device 1 according to FIG. 2A in a top view. FIG. 2C shows an associated sectional depiction along the section line A-A drawn in FIG. 2B. FIG. 2D shows a sectional depiction of the closure device 1 according to the second exemplary embodiment in its closed position.

The closure device 1 illustrated in FIGS. 2A to 2D has a similar basic structure and function to the closure device 1 described in relation to FIGS. 1A to 1I. The description above of the first exemplary embodiment thus also applies in principle to the second exemplary embodiment according to FIGS. 2A to 2D.

In contrast to the first exemplary embodiment however, in the closure device 1 according to FIGS. 2A to 2D, both the magnetic portions 21, 31 and the permanent magnets 211, 311 arranged therein each have a cross-section in the form of a non-rectangular parallelogram (see in particular FIGS. 2C and 2D). The first form-fit portions 23 and the second form-fit portions 33 are each formed by a face of the magnetic portion 21, 31 running obliquely to the closing direction Z.

In particular in a cascaded embodiment with at least three first magnetic portions 21 and the resulting at least two intermediate spaces 22 (as in the exemplary embodiment in FIGS. 2A to 2D), this has the following advantage: if the second closure part 3 is moved from a first closed position, in which it is received in a first intermediate space 22-1, into a second closed position, in which it is received in a second intermediate space 22-2, this may be achieved by a force F applied in a direction perpendicular to the closing direction Z, without the closure device 1 first having to be opened by a force acting against the closing direction Z, since the side faces of the magnetic portions with parallelogram-shaped cross-section deflect the force F accordingly. The closure device 1 thus acts similarly to a free-running device which blocks in one direction and can easily be adjusted in the other direction. Also, an opening of the closure device 1 can thereby take place particularly simply.

LIST OF REFERENCE SIGNS

1 Closure device
2 First closure part
20 Base body of first closure part
21 First magnetic portion
211 First permanent magnet
22, 22-1, 22-2 Intermediate spaces
23 First form-fit portion
231 First form-fit face
24 First guide portion
241 First guide face
25 First contact portion
26 Second contact portion
27 Second guide portion
271 Second guide face
3 Second closure part
30 Base body of second closure part
31 Second magnetic portion
311 Second permanent magnet
33 Second form-fit portion
331 Second form-fit face
34 First guide portion
341 First guide face
35 First contact portion
36 Second contact portion
37 Second guide portion
371 Second guide face
F Force
K1, K2 Magnetic forces
M1 First magnetization direction
M2 Second magnetization direction
N North pole
R1, R2 Relative movements
S South pole
XY, X'Y' Extension planes of base body
Z Closing direction

The invention claimed is:

1. A closure device for detachably connecting two parts together, comprising:

a first closure part which comprises at least two first magnetic portions which are spaced apart from one another and form an intermediate space between them, and a second closure part which comprises at least one second magnetic portion, wherein the first closure part and the second closure part can be placed against each other in a closing direction, such that the closure device assumes a closed position in which the at least one second magnetic portion is at least partially received in the intermediate space, wherein in the closed position, an attractive magnetic force, which is oriented substantially perpendicularly to the closing direction, acts between firstly the at least one second magnetic portion and each of the at least two first magnetic portions forming the intermediate space, wherein the first closure part comprises at least one first form-fit portion, and the second closure part comprises at least one second form-fit portion, wherein, in the closed position, the at least one first form-fit portion and the at least one second form-fit portion stand in form-fit engagement with each other, in order to prevent a relative movement of the closure parts against each other parallel to the closing direction, and wherein the at least one first form-fit portion comprises a first form-fit face arranged at an oblique angle with respect to the closing direction, and the at least one second form-fit portion comprises a second form-fit face arranged at an oblique angle with respect to the closing direction, the first form-fit face and the second form-fit face being in abutment with one another in the closed position.

2. The closure device as claimed in claim 1, wherein the first closure part comprises a plurality of first magnetic portions which are evenly spaced apart, wherein in each case two first magnetic portions form between them an intermediate space which is configured to at least partially receive the at least one second magnetic portion in the closed position.

3. A closure device for detachably connecting two parts together, comprising:

a first closure part which comprises at least one first magnetic portion and at least one first form-fit portion, and a second closure part which comprises at least one second magnetic portion and at least one second form-fit portion, wherein the first closure part and the second closure part can be placed against each other in a closing direction, such that the closure device assumes a closed position in which an attractive magnetic force, which is oriented substantially perpendicularly to the closing direction, acts between the at least one first magnetic portion and the at least one second magnetic portion, and wherein in the closed position, furthermore the at least one first form-fit portion and the at least one second form-fit portion stand in form-fit engagement with each other, in order to prevent a relative movement of the closure parts against each other in a direction parallel to the closing direction, and at least one of the magnetic portions comprises a cross-section in the form of a non-rectangular parallelogram, wherein at least one of the first form-fit portion and the second form-fit portion is formed by a face of the magnetic portion arranged at an oblique angle with respect to the closing direction.

4. The closure device as claimed in claim 3, wherein at least one of the magnetic portions comprises a permanent magnet which comprises a cross-section in the form of a non-rectangular parallelogram.

5. The closure device as claimed in claim 1, wherein on at least one of the closure parts, at least one first guide portion is provided which is configured, when the closure parts are placed against each other, to predefine a relative movement of the closure parts against each other in a direction perpendicular to the closing direction, in order to bring the at least one first form-fit portion and the at least one second form-fit portion into form-fit engagement with each other.

6. A closure device for detachably connecting two parts together, comprising:

a first closure part which comprises at least one first magnetic portion and at least one first form-fit portion, and a second closure part which comprises at least one second magnetic portion and at least one second form-fit portion, wherein the first closure part and the second closure part can be placed against each other in a closing direction and are loadable with a shear force applied perpendicularly to the closing direction, such that the closure device assumes a closed position in which an attractive magnetic force, which is oriented substantially perpendicularly to the closing direction, acts between the at least one first magnetic portion and the at least one second magnetic portion, wherein, in the closed position, furthermore the at least one first form-fit portion and the at least one second form-fit portion stand in form-fit engagement with each other, in order to prevent a relative movement of the closure parts against each other in a direction parallel to the closing direction, wherein at least one first guide portion is formed on at least one of the closure parts, the at least one first guide portion being configured, when the closure parts are placed against each other, to cause a relative movement of the closure parts against each other in a direction perpendicular to the closing direction, in order to bring the at least one first form-fit portion and the at least one second form-fit portion into form-fit engagement with each other, and wherein the at least one first magnetic portion and the at least one second magnetic portion are arranged behind one another collinearly with the action direction of the shear force occurring for assumption of the closed position.

7. The closure device as claimed in claim 6, wherein at least one of the magnetic portions comprises a cross-section in the form of a non-rectangular parallelogram, wherein the first form-fit portion and/or the second form-fit portion is formed by a face of the magnetic portion running obliquely to the closing direction.

8. The closure device as claimed in claim 6, wherein the at least one first guide portion is formed by a face of the magnetic portion running obliquely to the closing direction.

9. A closure device for detachably connecting two parts together, with:

a first closure part which comprises at least one first magnetic portion and at least one first form-fit portion, and a second closure part which comprises at least one second magnetic portion and at least one second form-fit portion, wherein the first closure part and the second closure part can be placed against each other in a closing direction such that the closure device assumes a closed position in which an attractive magnetic force, which is oriented substantially perpendicularly to the closing direction, acts between the at least one first magnetic portion and the at least one second magnetic portion, wherein, in the closed position, furthermore the at least one first form-fit portion and the at least one second form-fit portion stand in form-fit engagement with each other, in order to prevent a relative movement of the closure parts against each other in a direction parallel to the closing direction, wherein, on at least one closure part, at least one first guide portion and at least one second guide portion are provided, wherein the at least one second guide portion is configured, when the closure parts are placed against each other, to cause a first relative movement of the closure parts against each other in a direction perpendicular to the closing direction, in order to bring the respective other closure part into contact with the at least one first guide portion, and wherein the at least one first guide portion is configured, when the closure parts are placed against each other, to cause a second relative movement of the closure parts against each other in a direction perpendicular to the closing direction, in order to bring the at least one first form-fit portion and the at least one second form-fit portion into form-fit engagement with each other.

10. The closure device as claimed in claim 9, wherein the at least one first guide portion comprises at least one first guide face running obliquely to the closing direction, and/or wherein the at least one second guide portion comprises at least one second guide face running obliquely to the closing direction.

11. The closure device as claimed in claim 10, wherein the respective other closure part comprises at least one first contact portion for sliding on the first guide face, and/or at least one second contact portion for sliding on the second guide face.

12. The closure device as claimed in claim 6, wherein the at least one first form-fit portion and/or the at least one second form-fit portion comprises a form-fit face running obliquely to the closing direction.

13. The closure device as claimed in claim 6, wherein at least one of the at least one first form-fit portion and the at least one second form-fit portion is formed by an undercut on the respective closure part.

14. The closure device as claimed in claim 13, wherein at least one of the first and second form-fit portions, formed by an undercut on the respective closure part, comprises at least one form-fit face running substantially perpendicularly to the closing direction.

15. The closure device as claimed in claim 6, wherein the at least one first magnetic portion comprises at least one first permanent magnet with a first magnetization direction, and the at least one second magnetic portion comprises at least one second permanent magnet with a second magnetization direction.

16. The closure device as claimed in claim 15, wherein in the closed position of the closure device, the at least one first magnetic portion and the at least one second magnetic portion are arranged such that the first magnetization direction and the second magnetization direction run parallel to each other and are oriented substantially perpendicularly to the closing direction.

17. The closure device as claimed in claim 16, wherein in the closed position of the closure device, the at least one first magnetic portion and the at least one second magnetic portion are arranged behind one another in relation to the first magnetization direction and the second magnetization direction.

18. The closure device as claimed in claim 6, wherein at least one of the magnetic portions and/or at least one of the permanent magnets comprises a cross-section in the form of a non-rectangular parallelogram.

19. The closure device as claimed in claim 15, wherein the first closure part and the second closure part are formed structurally identically apart from the respective magnetization directions of the first and second permanent magnets.

20. The closure device as claimed in claim 6, wherein the second closure part comprises a plurality of second magnetic portions which are evenly spaced apart from each other, wherein in each case two second magnetic portions form between them an intermediate space which is configured to at least partially receive the at least one first magnetic portion in the closed position.

* * * * *